United States Patent [19]

Soderqvist

[11] Patent Number: 4,799,413

[45] Date of Patent: Jan. 24, 1989

[54] CUTTING ARRANGEMENT FOR INTERMITTENT CUTTING OF WEB MATERIAL

[75] Inventor: Ulf Söderqvist, Göteborg, Sweden

[73] Assignee: Roy Söderqvist Mekaniska Verkstad AB, Sweden

[21] Appl. No.: 68,269

[22] PCT Filed: Oct. 9, 1986

[86] PCT No.: PCT/SE86/00464

§ 371 Date: Jun. 19, 1987

§ 102(e) Date: Jun. 19, 1987

[87] PCT Pub. No.: WO87/02296

PCT Pub. Date: Apr. 23, 1987

[30] Foreign Application Priority Data

Oct. 21, 1985 [SE] Sweden ..... 8504925-2

[51] Int. Cl.[4] ..... B26D 5/26

[52] U.S. Cl. ..... 83/71; 83/72; 83/355; 83/369; 83/427; 83/434; 83/563; 83/577; 83/734

[58] Field of Search ..... 83/30, 71, 72, 355, 83/356, 427, 483–487, 575–577, 563, 369, 407, 734, 434, 509; 242/56.2–56.8

[56] References Cited

U.S. PATENT DOCUMENTS

| | | | |
|---|---|---|---|
| 1,128,036 | 2/1915 | Paulero | 83/577 |
| 2,746,548 | 5/1956 | Paris et al. | 83/575 |
| 3,151,514 | 10/1964 | Noveske | 83/575 |
| 3,486,400 | 12/1969 | Westmijze et al. | 83/576 |
| 3,760,675 | 9/1973 | Langworthy et al. | 83/482 |
| 3,811,313 | 5/1974 | Schut | 83/575 |
| 3,821,910 | 7/1974 | Tjaden | 83/577 X |
| 3,972,214 | 8/1976 | Jagersberger | 83/369 |
| 4,026,172 | 5/1977 | Off et al. | 83/369 |
| 4,062,213 | 12/1977 | Schneider et al. | 83/72 |
| 4,358,975 | 11/1982 | Higgins | 83/487 |

*Primary Examiner*—Frank T. Yost
*Assistant Examiner*—Eugenia A. Jones

[57] ABSTRACT

A cutting arrangement for the cutting to shape of a web-shaped material, such as paper webs (2) in printing presses. The arrangement consists of a cutting element (8) and a backing element (3) over which the paper web runs, in conjunction with which one edge of the cutting element (8) is brought intermittently into contact with the paper web for the purpose of cutting through the paper web in its longitudinal sense. The cutting element (8) is so arranged as to change its position intermittently in relation to the paper web (2) between a first, advanced position in which the cutting element (8) uses its edge to cut through the paper web as it passes over the backing element and a second, withdrawn position in relation to the paper web in which the cutting element is not in contact with the paper web. The intermittent movements of the arm between the first and the second position are controlled by a control unit (12) depending on the advance of the paper web (2). In this way intermittent cut lines (14) appear in the paper web in its longitudinal sense with a pre-determined starting and finishing point in relation to the paper web.

1 Claim, 3 Drawing Sheets

CUTTING ARRANGEMENT FOR INTERMITTENT CUTTING OF WEB MATERIAL

TECHNICAL FIELD

The present invention relates to a cutting arrangement for the cutting to shape of a web-shaped material, such as paper webs in printing presses. The kind of cutting arrangements concerned are those which contain a cutting element and a backing element over which the paper web runs, in conjunction with which one edge of the cutting element is brought intermittently into contact with the paper web for the purpose of cutting through the paper web in its longitudinal sense.

BACKGROUND

Within the highly automated graphical industry for the production of periodicals and daily newspapers, printing, collating the pages of the newspaper, joining together the newspaper, for instance by glueing or stapling, and cutting the newspaper to its correct dimensions take place fully automatically through the use of various kinds of graphical machines. The finished newspapers are discharged from the production line at very high speed for packing into bales. If a separate supplement, a so-called tabloid such as an advertising supplement with dimensions which do not coincide with the dimensions of the newspaper, is to be inserted into the finished newspaper, this operation must be performed manually at a later stage, which increases the cost of production and is very time-consuming.

If, for example, the dimensions of the tabloid are one half of the dimensions of the newspaper, the procedure has already been disclosed of printing two parallel tabloids alternately with the newspaper on a long web of paper drawn from a roll, in conjunction with which a special cutting device separates the two tabloids from one another by cutting in the longitudinal sense of the web of paper. This cutting device usually consists of a rotating disc, the diameter of which is the same as the diameter of the cylinder against which the web of paper runs, said disc being held continuously in contact with the cylinder with the same direction of rotation relative to the cylinder. One half of the periphery of the disc is also provided with a sharp cutting edge, so that the disc cuts the paper for half of its rotation against the paper web and makes only light contact against the paper web for the other half of its rotation.

TECHNICAL PROBLEM

Cutting devices in the form of rotating discs take up space, are often very difficult to adjust, and provide unsatisfactory accuracy, especially at high web speeds. Previously disclosed cutting devices usually contain many moving parts, which call for extensive supervision and servicing.

THE SOLUTION

A cutting device is achieved through the invention which eliminates the disadvantages of previously disclosed technology and consists of a cutting element which is so arranged as to change position intermittently relative to the paper web between a first, advanced position in which the cutting element uses its edge to cut through the paper web as it passes over the backing element and a second, withdrawn position in relation to the paper web in which the cutting element is not in contact with the paper web. The intermittent movements of the arm between the first and the second position are controlled by a control unit depending on the advance of the paper web, in such a way that intermittent cut lines appear in the paper web in its longitudinal sense with a pre-determined starting and finishing point in relation to the paper web.

BRIEF DESCRIPTION OF DRAWINGS

The invention is described below in greater detail as an illustrative embodiment with reference to the accompanying drawings, in which.

BEST MODE OF CARRYING OUT THE INVENTION

Figure 1:
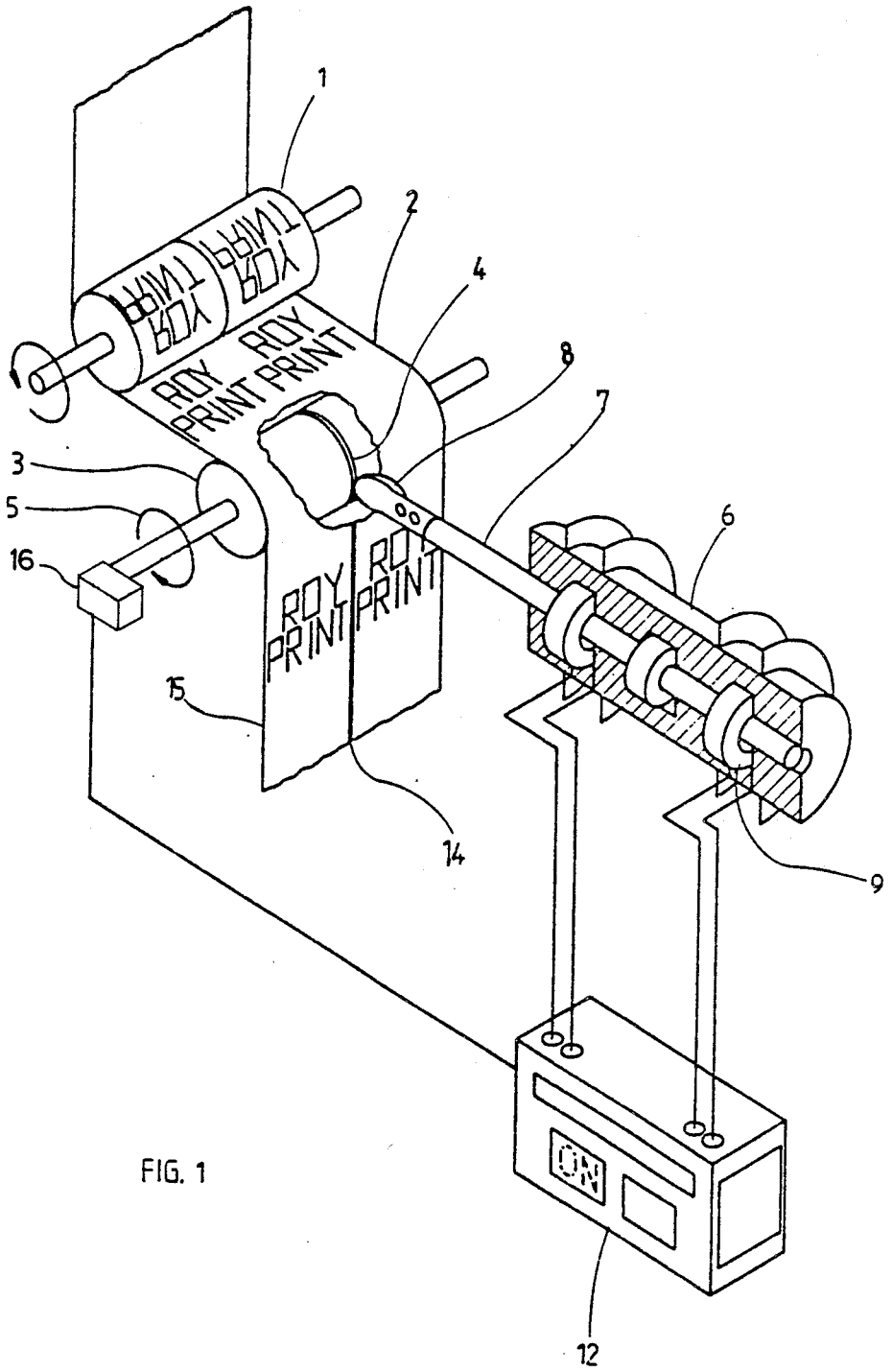
FIG. 1 shows a diagrammatic perspective view of part of a printing press equipped with the cutting arrangement in accordance with the invention.
Figure 2:
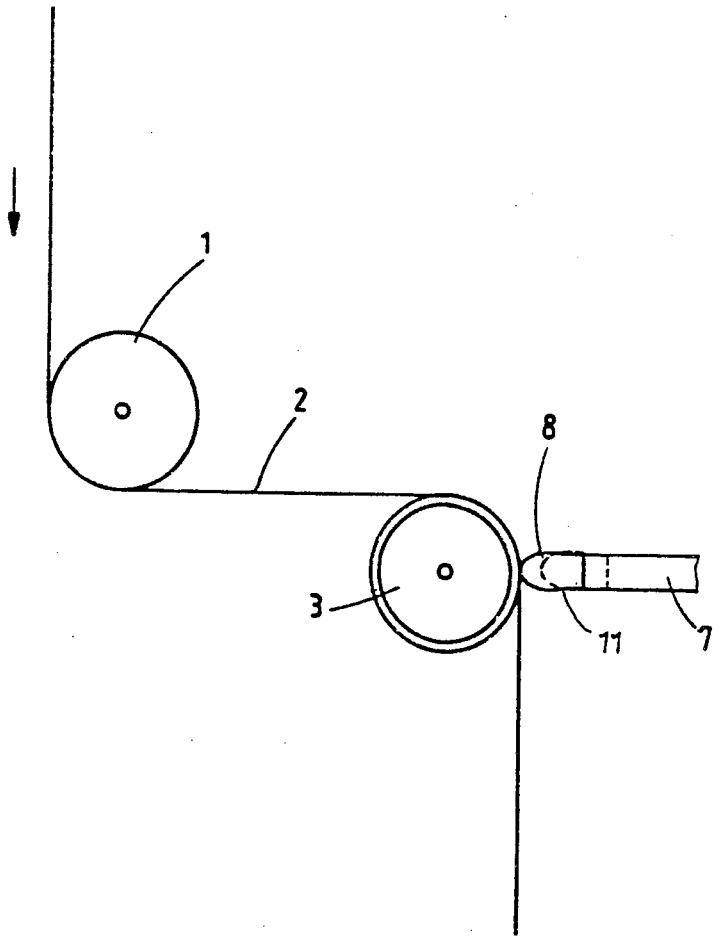
FIG. 2 shows a diagrammatic side view of the printing press with the cutting device.
Figure 3:
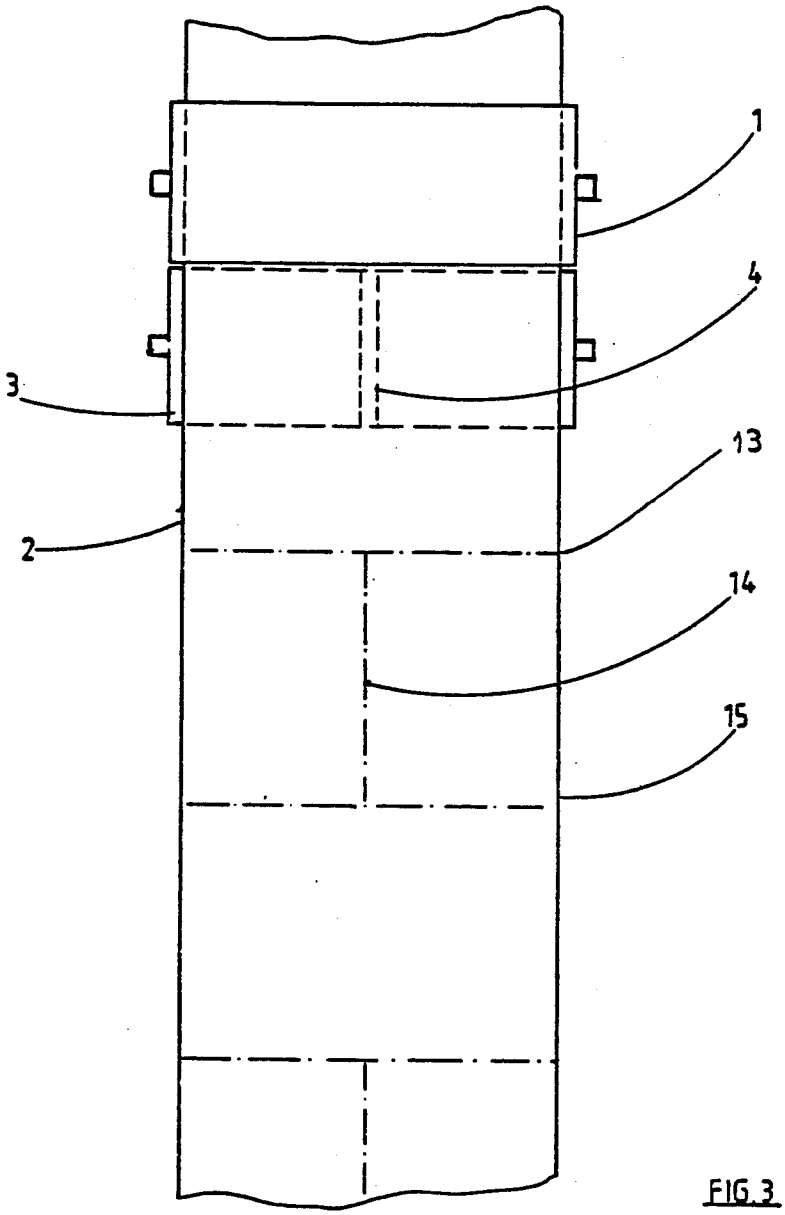
FIG. 3 shows part of the printing press viewed directly from the front, but with the cutting device omitted.

As will be appreciated from the example illustrated in FIGS. 1, 2 and 3, the printing press consists of a rotating printing cylinder 1 which can be of a type designed for printing plates or for off-set printing and intended to produce a printed image on a long web of paper 2 running through the printing press and drawn from a roll of paper (not shown here), and a rotating back-pressure cylinder 3 situated at a certain distance from the printing cylinder and preferably provided with a peripheral groove 4 extending around the cylinder, which cylinder is so arranged as to be caused to rotate in a particular direction 5 of rotation by means of a drive motor (not shown here), in conjunction with which the long web of paper 2 is so arranged as to run over the surface of the back-pressure cylinder and preferably as to be drawn forwards by other cylinders (not shown here). Situated on the back-pressure cylinder is a power arrangement 6 for the cutter arrangement in accordance with the invention which comprises a long cutting arm 7 in the form of a rod-shaped element, which is provided at one end with a replaceable cutting element 8, such as a knife or a small, thin, rotating disc, the edge of which is very sharp and is directed continuously against the back-pressure cylinder 3 directly in line with its groove 4. The cutting arm 7 is so arranged at its other end as to fit freely inside the power arrangement 6. The power arrangement also contains a number of electromagnets 9 consisting of fixed, electromagnet coils of toroidal form, through which the end of the cutting arm extends. By the appropriate choice of the direction of force of the electromagnetic field, the cutting arm, which is made of a magnetizable material, can be caused to move between a first, advanced position as shown in FIG. 2, in which the cutting element is in contact with the back-pressure cylinder 3 and the paper web 2, and a second, withdrawn position 11, as shown in FIG. 2 with dotted and dashed lines. It is also possible to move the cutting arm between the aforementioned positions by means of a hydraulic cylinder or a pneumatic cylinder.

The power arrangement 6 has an associated control unit 12, preferably of the PC computer type, connected to it for the purpose of controlling the positions of the cutting arm 7 depending on the rotational position of the back-pressure cylinder, which position is sensed by an angular pulse generator 16 connected to the back-pressure cylinder, so that the cutting arm is imparted with a movement cycle in relation to the rate of advance of the long length of paper such that a desired length of a cut 14 through the paper web 2 is achieved, enabling the width of the paper web to be divided into two tabloids 15.

The long paper web 2 is fed out continuously from the roll at the start of the printing press production line and past and over the printing cylinder 1, where the paper is provided with the printed image, in such a way that the ordinary pages of the newspaper and the tabloids 15 are printed alternately on the paper. The paper web 2 is also fed over the back-pressure cylinder 3 and onwards over the cylinders (not shown here) for the final cutting of the paper web transversely to its longitudinal sense, as illustrated schematically in FIG. 3 by dotted and dashed lines 13.

Only a single paper web of the long paper web 2 is shown in the drawings, although it is possible for a number of paper webs to pass one beneath the other and to run in parallel alongside one another for the purpose of bringing them together to form a multi-layer paper web for cutting, in which case the dotted and dashed lines 13 shown in FIG. 3 across the longitudinal sense of the paper web, together with the outer edges of the paper web, define the external dimensions of the finished newspaper, and the line which extends along the longitudinal sense of the paper web and between the dotted and dashed lines 13 indicates a cutting line 14 through the paper, by means of which the tabloids 15 are formed, and the external dimensions of which are defined by the dotted and dashed lines 13, the cutting line 14 and the outer edge of the paper web.

The revolution 5 described by the back-pressure cylinder is divided into a number of reference degree units, where 0° is used to indicate a zero point which the control unit takes as a reference point for the purpose of controlling the power arrangement 6, which degree units are detected by the angle impulse indicator. In a first angular position of the back-pressure cylinder 3, i.e. a pre-determined first degree unit, which is detected by the angle impulse indicator, the control unit activates the magnetic field of the electromagnets 9 inside the power arrangement 6 so that the cutting arm 7 projects essentially horizontally from the power arrangement towards the back-pressure cylinder 3, in which case the cutting element 8 is brought into contact with and cuts through the paper in the first, advanced position 10, as shown in FIG. 2. The sharp edge of the cutting element will in this case cut through the paper web with high precision, starting at a pre-determined starting point of the paper web 2 relative to its printed areas, at the same time as which the paper web is being fed continuously over the back-pressure cylinder 3, so that the cutting line 14 is produced with a pre-determined length to which the distance between the transverse, dotted and dashed lines 13 in FIG. 3 corresponds, depending on the reference degree units, which cutting line divides the paper into two equally large parts so as to form the tabloids 15. The cutting element 8 is applied to the paper web 2 with a certain force for this purpose, which force is adapted to the thickness of the paper, in conjunction with which the groove 4 provided in the back-pressure cylinder 3 facilitates the cutting-through of the paper web because the cutting element makes contact by its edge to a certain extent in the groove at a distance from its surfaces, in conjunction with which the wear on the cutting element is also reduced because the edge is not in contact with the hard surface of the back-pressure cylinder. The position of the cutting arm relative to the back-pressure cylinder 3 is adjustable for this purpose so that the length of stroke of the arm can be regulated in order to adapt it to the thickness of the long paper web and the number of layers of the paper web which run over the back-pressure cylinder, in conjunction with which the aim should be to achieve the shortest possible length of stroke, which is important for the capacity of the power arrangement.

At a second angular position of the back-pressure cylinder, i.e. a second pre-determined degree unit which is also detected by the angle impulse indicator, the control unit 12 will change over (this may be the same as the first angular position, but one revolution later) the magnetic field of the electromagnets 9 in the power arrangement 6 so that the cutting arm 7 is withdrawn from the back-pressure cylinder 3 towards the power arrangement and into the second, withdrawn position 11 in which the cutting element 8 is situated at a distance from the paper web 2, in conjunction with which the cutting-through of the paper will cease at a precisely pre-determined finishing point, in conjunction with which the paper web will be fed over the back-pressure cylinder for a certain distance, to which the distance between two of the dotted and dashed lines 13 in FIG. 3 corresponds, but without being cut through the cutting element 8. The power arrangement is then re-activated by the angle impulse indicator and the control unit detecting a new reference degree unit, so that the cutting arm is caused to move towards the paper for the purpose of cutting it through. The intermittent movement of the arm thus takes place continuously as the paper web is being advanced. The revolution 5 described by the back-pressure cylinder 3 can be divided up into any desired number of cycles in accordance with the diameter of the back-pressure cylinder on the one hand, and with the desired length of the cutting line 14 on the other. In the illustrated example the cutting lines 14 exhibit the same length as the space between the cutting lines.

The invention is not restricted to the illustrative embodiment described above and shown in the drawings, but may be modified within the scope of the following Patent claims. Thus, for example, the angle impulse indicator can be synchronized with photocells which recognize printed marks on the paper web in order to eliminate the risk of the paper web sliding on the back-pressure cylinder, when the cutting line may be displaced in relation to the text on the paper. The cutting arm need not act in the horizontal plane, but may execute its function by acting in all directions by describing a movement respectively towards and away from the paper web. The back-pressure cylinder 3 can be replaced by some other backing device, such as a fixed plate over which the web passes.

I claim:

1. A cutting device for cutting an elongated moving web of material, such as a paper web, the web of material moving in the longitudinal direction thereof, the device resting on a support means, such as a floor and comprising a motor driven cylinder provided with a peripheral groove extending around the cylinder, said moving paper web being directed to run over the cylinder;

a power device comprising a plurality of fixed electromagnetic coils of toroidal form, an arm made of magnetizable material extending through said coils, said arm extending horizontally with respect to the support means and having at one end a blade-like cutting member located directly in front of said groove on the cylinder and being nonrotationally fixed in a predetermined horizontal location with respect to the movement of the web;

an angular pulse generator located at the cylinder axis to measure certain angular positions during the rotation of the cylinder; and a control unit connected to the angular pulse generator to determine the angular positions of the cylinder and actuate the power device to move the arm intermittently, linearly in a horizontal plane with respect to the support means between a first retracted position having said cutting edge spaced from the paper web and a second extended position in which the cutting member has its edge lying in the groove and engaged against the paper web for a predetermined portion of the angular rotation of that cylinder to permit the paper to move with respect to said cutting member so that cutting member cuts through the paper web for a predetermined longitudinal distance of the web to define an elongated cut extending longitudinally in the paper web and divide that paper web into at least two elongated tabloids which extend along the longitudinal direction of the web and which are separated from each other.

* * * * *